US005404602A

United States Patent [19]

Kondo

[11] Patent Number: 5,404,602

[45] Date of Patent: Apr. 11, 1995

[54] BEDCLOTHES ANCHORING APPARATUS

[76] Inventor: Victor F. Kondo, P.O. Box 1456, Paradise, Calif. 95967

[21] Appl. No.: 185,033

[22] Filed: Jan. 24, 1994

[51] Int. Cl.[6] ..... A47G 9/04

[52] U.S. Cl. ..... 5/504.1; 24/72.5; 24/499; 24/514

[58] Field of Search ..... 5/496, 498, 658, 504.1, 5/505.1, 923; 24/72.5, 514, 499

[56] References Cited

U.S. PATENT DOCUMENTS

| | | | |
|---|---|---|---|
| 420,083 | 1/1890 | McArthur . | |
| 443,742 | 12/1890 | Birdsall . | |
| 852,180 | 4/1907 | Hoffman . | |
| 1,365,169 | 1/1921 | Goldberg . | |
| 2,223,412 | 12/1940 | Gartz . | |
| 2,321,394 | 6/1943 | King | 24/72.5 |
| 2,459,497 | 1/1949 | Calabro | 5/498 |
| 2,931,084 | 4/1960 | De Witt | 5/498 |
| 4,199,830 | 4/1980 | Ogata | 5/498 |
| 4,662,016 | 5/1987 | Seeman | 5/498 |

FOREIGN PATENT DOCUMENTS

| | | | |
|---|---|---|---|
| 13551 | of 1914 | United Kingdom | 24/72.5 |

*Primary Examiner*—Alexander Grosz

[57] ABSTRACT

A flat plate-like anchor with adjustably attached flexible strap is positioned between the box springs and mattress toward the head of the bed. The adjustable attachment of the strap to the anchor allows varying the effective length of the strap for use on different thicknesses of mattresses. The strap is drawn up across the edge of the mattress to have a distal end thereof on the top of the fitted sheet covering the mattress. The end of the strap has an affixed portion of hook and loop fastener. An openable pinch clamp is positioned on the top of the lower or fitted sheet adjacent the strap, and the upper edge of the top sheet and blanket are tightly clamped in the releasable clamp. The clamp includes a pivotally attached extending tab having a mating portion of hook and loop fastener for attaching to the fastener of the strap. The pivotal attachment of the extending tab allows it to be positioned to the left or right side, or to the rear of the clamp, thus allowing the clamp to be used on the left or right side of the bed, or at the center head of the bed. A lower portion of the clamp, which in use is positioned under the bedding, is preferably extended slightly so as to be longer than the upper portion of the clamp, to serve as a starter guide to aid in more readily placing the bedding within the clamp.

4 Claims, 5 Drawing Sheets

BEDCLOTHES ANCHORING APPARATUS

BACKGROUND OF THE INVENTION

1. Field of the Invention

The present invention relates to apparatuses and devices structured for holding bedclothes or bed coverings such as top sheets, blankets and possibly bedspreads in place on a bed while the bed is slept in. The present invention also renders a bed easier to make after the bed has been slept in.

2. Description of the Prior Art

The following is a listing of relevant prior art of which I am aware, and which illustrates the present state of the art in this field. The prior art devices are somewhat numerous, which I believe indicates the perception, over an extended period of time, that further improvement in devices for anchoring bedclothes still exists. Additionally, although the field of devices concerning the anchoring of bedclothes is relatively old and crowded, over the years several new forms of beds have been introduced, rendering some of the prior art anchoring devices completely unusable on these new beds. Recent developments in bed structures, at least in the U.S.A., include air inflated beds, water or floatation beds, and futons. Typically air beds and floatation beds include open-topped box frames which do not include bed frame side support rails or exposed under-springs relied upon by many prior art anchoring devices. Additional problems in the prior art devices include clamping or pinching structures which cannot be sufficiently tightened by the user onto the bedding so as to prevent the bedding from slipping from the clamp during the night. Another problem in the prior art devices is the reliance upon clamping structures which are applied to the bedding which include sharp teeth. These sharp teeth are to prevent the slipping of the bedding from the clamp, but, they have the drawback of cutting or punching holes into the bedding which is clearly damaging and therefore undesirable. Another problem present in some of the prior art devices is the requirement that screw or nail holes be permanently made in the bed frame or post, which would be objectionable to many who have fancy or expensive wood bed frames and headboards. Yet another problem in prior art devices is the use of anchoring straps which rely on the availability of exposed bed posts or rails which are not always present on many modern beds. A still further problem in some of the prior art devices is insufficient adjustability for accommodating different thicknesses of mattresses, as mattresses can vary greatly in thickness. Some mattresses are only about 4 inches thick, while others are 12 to 14 inches thick. A further problem existing in some prior art devices is the restrictions on placement on the bed, leaving the user with few optional placements of the anchoring device on the bed.

Although all of the hereinabove described shortcomings do not exist in any single prior art anchoring device for bedclothes, all of the following prior art structures do have one or more of the above described problems.

U.S. Pat. No. 4,662,016, issued on May 5, 1987 to Ronald D. Seeman, teaches a bedclothes retainer. The Seeman device includes a small spring clip having sharp teeth and which is attached to a hook and loop anchoring piece by a flexible strap. As mentioned above, the sharp or jagged teeth would damage the bedclothes with a strong pull. Furthermore, it is suggested the anchor piece of Seeman's retainer is backed with an adhesive for attachment to the bottom of the mattress, bed frame or box springs. Seeman's anchor member appears too small to be adequately retained in position without the adhesive, yet the adhesive eliminates periodic removal of the retainer as desired.

R. X. McArthur was issued U.S. Pat. No. 420,083 on Jan. 28, 1890 for a clamp for holding bedclothes. McArthur's clamp includes a wide elastic band affixed on one end with an attachment hook, and on the opposite end a clamping member. The attachment hook requires permanent alteration of the bed frame by the application of a screw or nail for retaining the clamp in position. Most people would not want to place a screw into their bed frame.

A sheeting holder was patented on Apr. 5, 1960, U.S. Pat. No. 2,931,084, by H. K. De Witt. De Witt's sheeting holder includes a resilient strap affixed on one end with a hook, and the other end affixed with a clamping member. The hook is designed for placement over the side support rail of the bed frame, however not all beds have exposed side rails, such as water and air beds with wooden box frames, or futons which are often placed directly on the floor. De Witt's clamp also does not appear to be strong enough to adequately retain bedclothes when there is a strong pull on them, such as when a sleeper rolls over during the night. The small, slidable button on the clamp, which serves to force the clamp closed, would be excessively hard to manipulate for older people, especially those suffering from arthritis, and therefore it is doubtful the clamp could normally be applied sufficiently tight as to adequately hold bedclothes from being inadvertently pulled from the clamp.

S. Goldberg was granted U.S. Pat. No. 1,365,169, on Jan. 11, 1921, for a bedclothes holder. The Goldberg holder includes a flexible strap retained onto the spring rail of the bed frame with a buckle arrangement. The opposite end of the strap is affixed with a gripping clamp having a locking lever. Again, not all beds have spring rails for use with this type of attachment. Those beds that do have spring rails generally have the full weight of the bed and box springs resting on them which would make it difficult, especially for older people, to loop the end of the strap over the spring rail while holding the edge of the mattress and box springs upward above the rail in order to initially wrap the strap around the rail.

A. E. Birdsall was issued U.S. Pat. No. 443,742, on Dec. 30, 1890, for a bedclothes fastener. Birdsall's fastener includes a strap for attachment around the side bars of the bed frame, with the strap connected to a detachable hook, which is in turn affixed to a safety pin. While the safety pin may securely retain the bedclothes, it requires puncturing the material which may permanently damage some fabrics. Additionally, there does exist the possibility the safety pin could come open during the night to leave the sharp point exposed to stick the sleeper.

A bedclothes holder was patented on Jan. 18, 1949, U.S. Pat. No. 2,459,497, by H. D. Calabro. Calabro's holder includes a large, flat and flexible anchor member endwardly affixed with two flexible connecting members or straps affixed with clothes-pin type clamps. It is doubtful that clothes-pin type clamps would have sufficient holding strength absent sharp biting teeth which would damage bedclothes, and absent any anti-slip covering such as a padding or rubbery covering as used with the present invention to be disclosed. Additionally, the large flexible anchor member or anchor plate of Calabro would be difficult to insert under a large heavy mattress due to the flexibility of the anchor member. Since the Calabro's anchor member is comprised of flexible material, it cannot be pushed between the mattress and box springs, but rather, it must be laid in place. An anchor member placed between the box springs and the mattress must periodically be removed to change the box spring cover or dust ruffle, and a flexible anchor such as that of Calabro's would be difficult to install due to its flexibility. Additionally, a flexible anchor plate has the disadvantage of bending, and if the anchor plate is placed near the edge of the mattress, which is where it is most convenient to be placed for installation and removal thereof, a bendable anchor plate is far more likely to pull out from underneath the mattress with pulling force applied to the bedclothes to which the anchor is attached via the strap between the bedclothes and the anchor plate. This increased likelihood of pulling out is relative to a rigid anchor plate, as used with the present invention to be disclosed. With a flexible anchor plate such as Calabro's, the plate can bend and flex upward around the edge of the mattress, following the side edge of the mattress upward and finally slipping completely free of the mattress under a pull on the strap. With a rigid or substantially non-bendable anchor plate such as I use, under a pull, the anchor cannot bend upward and follow the pull direction of the strap, and thus in order for it to slip from under the mattress, the forward end of the rigid anchor would have to move straight laterally outward from the mattress, which is in the opposite direction of the pull on the strap connected to the anchor plate, sufficiently far for the trailing end to free the mattress, which is clearly very unlikely. Most mattresses are somewhat flexible at the corner edges, which renders it easier to pull any anchor plate out from underneath the mattress whether the anchor is flexible or rigid, however, if the rigid anchor plate is sufficiently long, even with a highly flexible mattress corner, the anchor plate will not pull out under normal expected pulls on bedclothes which may be rendered stationary by the anchor plate, which is the arrangement with my invention as will be further disclosed.

U.S. Pat. No. 852,180, was issued to A. M. Hoffman on Apr. 30, 1907, for a bedclothes fastener. Hoffman's fastener includes an elongated cord having a loop on one end for attachment around the bed rails or spring rails of the bed frame, and two spring clamps affixed on the opposite end for attachment to the bedclothes. The disadvantages of attachment to the bed rails or spring rails of the bed have previously been mentioned, and the spring clamps of the device have serrated teeth which might damage the bedclothes.

G. W. Gartz was granted U.S. Pat. No. 2,223,412, on Dec. 3, 1940, for a comforter anchor. Gartz's anchor includes a flexible strap affixed on one end to a rubbery resilient anchor member, and a snap fastener on the opposite end for releasable connection to a mating snap fastener attached to the comforter. Rubbery and resilient equates to flexible, and the disadvantages of a flexible anchor plate is hereinabove described. Gartz's device requires the attachment of a snap fastener to the lower edges of the comforter, which may result in damaging the material.

SUMMARY OF THE INVENTION

For the sake of briefness of this disclosure, I will not detail all of what I feel would be obvious variations to many of the structures which are about to be described and which are shown in the drawings.

The present invention is an apparatus or device structured for holding bedclothes such as top sheets, blankets and possibly bedspreads in place on a bed while the bed in slept in, and for aiding in the quick making of the bed in the morning by holding one portion of the bedclothes stationary. My invention overcomes the shortcomings present in the related prior art devices. My invention is primarily structured to hold the top bedclothes stationary on one side or the other of a bed, near the head of the bed, leaving the oppositely disposed upper side corner of the bedding loose for turning down, allowing ingress and egress. The invention may also be applied in the center head of a large or double bed as will be disclosed. When the invention is applied to the upper corner of the bed, the corner of the user's choice toward the head or headboard, after one has entered the bed, during sleep, the upper corner of the bedding to which the invention is attached remains generally stationary, and the sleeper will not inadvertently roll and draw the bedding loose from that corner. I have found that as long as the upper corner of the bedding remains in place, the bedding if tucked in along that lengthwise side, will remain in place. If the upper corner gets loose, that entire lengthwise side edge of the bed is far more likely to become untucked or disarranged during the night, which will more easily allow the sleeper to inadvertently draw or slip out from underneath the bedding, and will render the bed more difficult and time consuming to make in the morning. When my invention is used, in the morning after leaving the bed, the bedding has remained relatively neat and in place on the entire lengthwise side of the bed to which the invention was applied, and so to make the bed, one need only to grasp the loose upper corner of the bedding which is oppositely disposed from the invention, and pull it forward and across to make the bed. The invention applied to the one upper corner maintains that corner neat and anchored, and allows the pulling of the bedding taut, away from the invention and the stretching of the bedding to remove unsightly wrinkles.

My invention is structured to be simple to use, inexpensive to manufacture, highly effective, non-damaging to the bed and bedding, and to be versatile in its placement on the bed. My invention is structured to allow the quick and easy removal thereof for changing the bedclothes, mattress and box spring covers or dust ruffle. My invention is also structured to be quick and easy to install. The clamp used as part of the invention, having two opposing jaws, one upper and one lower, has the jaws covered with padding or rubbery material to protect the bedclothes from damage under high clamping pressures, and to aid in preventing the bedclothes from slipping free of the clamp. Additionally, the lower jaw, which is inserted underneath the bedclothes to be clamped, includes a forward extending portion or flange which extends outward beyond the upper jaw to serve as a guiding or starter lip when slipping the bedclothes between the open jaws in preparation for clamping. My invention uses an elongated substantially rigid plate-like anchor having an adjustably attached elongated flexible strap. The anchor is a thin, elongated planar member or plate which is positioned between the box springs and the mattress near the head of the bed. The anchor is absent sharp corners and the like which might damage a mattress, and which would hinder the sliding insertion of the rigid anchor underneath the mattress. The anchor plate may be slipped between the mattress and whatever surface is supporting the mattress, since not all mattresses are supported on box springs. The anchor remains in place simply by the weight of the mattress, and the size and shape, and thus surface area of the anchor which is frictionally engaged with the mattress. The thinness, rigidity, and absence of sharp corners allows my anchor to be pushed, one edge first, underneath even a heavy mattress, without having to lift the mattress. The elongated strap which is adjustably attached to the anchor is to allow for large increment adjustments to accommodate differing thicknesses of mattresses, and this allows for generally installing the anchor the same distance inward underneath a mattress generally regardless of the thickness of the mattress. It is desirable to place the plate-like anchor underneath the mattress an adequate distance inward from the mattress edge so sufficient weight (pressure) and frictional adhesion occur to cause the anchor to remain properly in place during use, and this without having to insert the anchor an excessive distance inward of the edge of the mattress. With my rigid and elongated anchor, the anchor may be inserted to the point where the anchor just disappears under the mattress, and due to the rigidity of the anchor, and with its length positioned perpendicular to the adjacent edge of the bed, it will not be pulled out under normal use. It can be appreciated that with the rigid anchor so close to the edge of the mattress, that one can easily pull straight out on the anchor or strap to remove the anchor when desired. It is more difficult to place the anchor, any anchor plate, a great distance inward from the edge of the mattress, and it is more difficult to retrieve the anchor from far underneath a heavy mattress, and these problems do not exist with my anchor. With my invention, the elongated strap is brought up from underneath the mattress from its attachment to the anchor under the mattress, and placed upward across the side edge of the mattress to position a terminal or distal end of the strap on the top of the bottom or fitted sheet covering the mattress, and overhanging the top edge of the mattress about two to ten inches. The end of the strap has an affixed one-half portion of hook and loop fastener.

The openable clamp, in part described above, which may be a spring clamp or a set-screw type clamp, is positioned on the top of the fitted sheet adjacent the strap, and the upper edge of the top sheet and blanket, and the edge of the bedspread if desired, are tightly clamped within the releasable clamp. If a spring biased clamp is used as a component of my invention, and it is in one structural embodiment of the present invention for clamping onto the bedclothes, its jaws are covered with a padding or rubbery material to prevent slippage of the bedclothes from the clamp, and to prevent damage to the bedclothes. Another embodiment of my invention utilizes a C-style clamp having a handle and rotary screw for closing the padding or rubbery covered jaws onto the bedclothes. Which ever clamp is utilized with the present invention, the clamp includes a pivotally attached extending tab, which is essentially a short strap having a mating portion of the hook and loop fastener for adjustably attaching to the fastener of the elongated strap of the anchor. The pivotal attachment of the extending tab to the clamp allows it to be pivoted to the left or right side of the clamp, or toward the rear of the clamp, and this generally without bending or folding the extending tab, and thus allows my bedclothes holding apparatus to be used either on the left or right side corner of the bed near the head as hereinabove described, or to be positioned with the clamp in the center of a large bed with the anchor placed at the center head of the bed with the flexible strap extending up the center head of the mattress. This center use position of my invention would primarily be used on a large bed wherein two people sleep in the bed. In this center use position, the bed is easier to make in the morning since the bedding has been maintained in the center, having been prevented from slipping toward one side or the other, and it also prevents one sleeper from inadvertently drawing the covers off of the other. Although it is normally substantially easier to insert and remove my anchor plate on a side edge of the mattress for applying the clamp in left side or right side upper corner positions on the bed, my invention may be utilized in the center head of the bed.

The pivotal attachment of the extending tab to the clamp provides for using the same structure in various locations on the bed, while also maintaining the pull or loading on the clamp to be such that the releasable connection of the strap to the extending tab is not cocked excessively sideways, and are thus less likely to disconnect. The extending tab additionally includes a lateral extending portion which serves as a graspable tab member or handle which the user may grasp between his fingers while connecting the elongated strap to the extending tab. The graspable tab member or handle of the extending tab is off to the side of the fastener on the tab which mates with the fastener on the distal end of the strap, and thus the user may easily hold the tab while pulling the strap to remove all slack within the tab and strap between the clamp and the anchor to better secure the bedclothes in place and to prevent the bedclothes from becoming untucked adjacent the extension of the elongated strap from underneath the mattress. The adjustability in overlap in the elongated hook and loop fasteners on the distal ends of the strap and extending tab allows for affixing the clamp to the bedclothes, followed by connecting the extending tab to the strap without leaving any slack in the strap and tab between the clamp and anchor.

Therefore it can be appreciated that some of the objects of the present invention include providing a simple to use bedding anchor for rendering certain portions of upper bed covers relatively stationary on a bed, and which is versatile in its placement on the bed; non-damaging to the bed and bed covers; highly adjustable to accommodate different thicknesses of mattresses and bedclothes, and which is readily attachable and detachable to allow changing of the bedding.

These, as well as other objects of my invention will become better appreciated from continued reading, and with an examination of my attached drawings exemplifying preferred structures of the invention.

DESCRIPTION OF THE PREFERRED EMBODIMENTS

With reference now being made to the drawings wherein my invention is illustrated in two preferred structural embodiments for example, the first embodiment utilizes a modified "C" clamp 10 structure, and the second embodiment utilizes a modified spring biased clamp 12, and essentially the only differences between the two embodiments is in the type of clamp used, and the location and structure utilized to pivotally connect the extending tab 16 to the clamp. Therefore, generally, like parts on each embodiment will be given like identification numbers.

Figure 1:
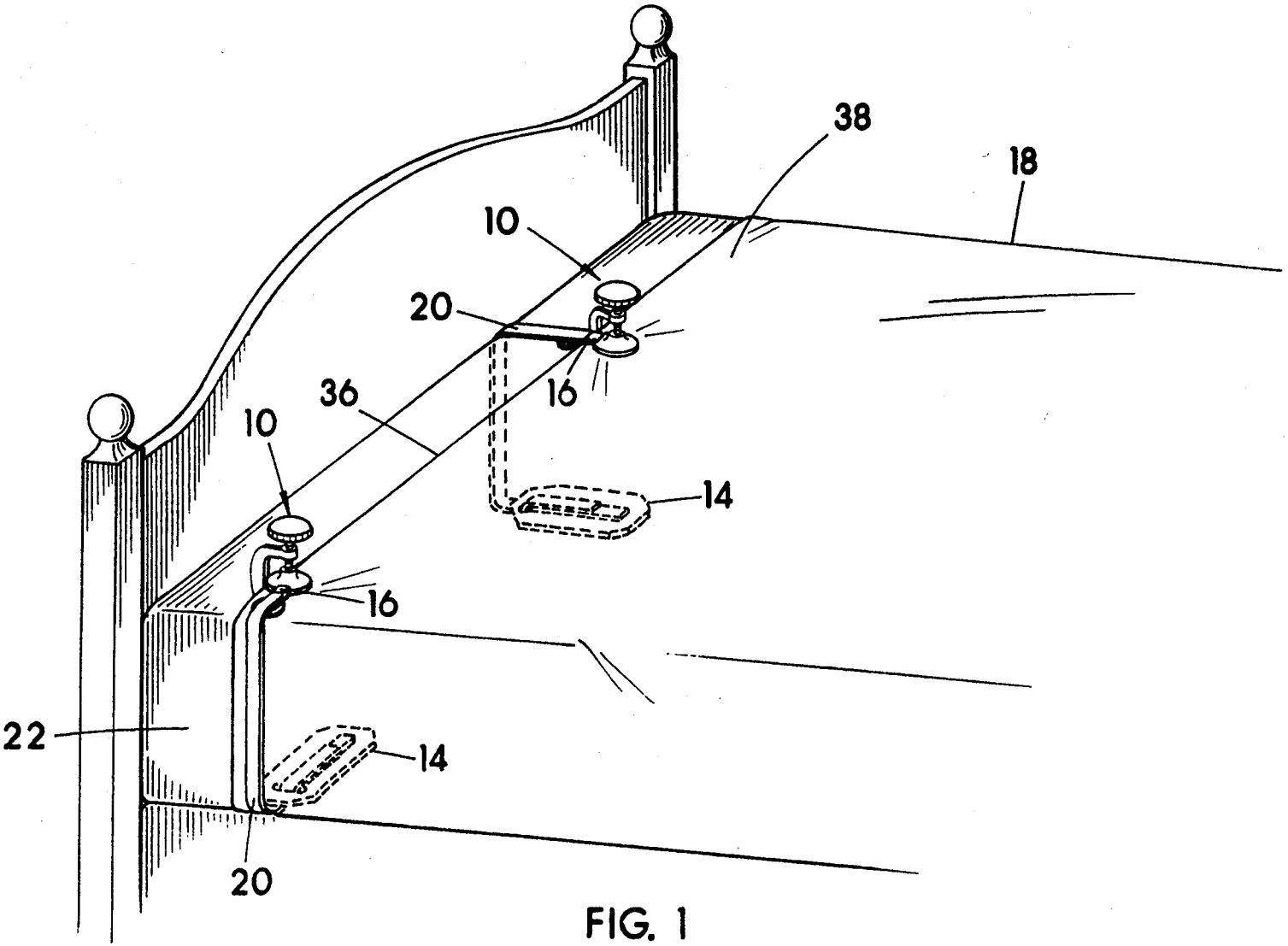
FIG. 1 is an illustration of a first structural embodiment of my invention shown in two different locations on a bed with the anchor placed between the box spring and mattress. The two different locations of use are to illustrate typical use positions for example, although typically only one of my bedclothes anchoring apparatuses would be used at one time on a bed. The invention could also be placed with the clamp on the side edge of the bed, although this is not shown in the drawings.

FIG. 1 is an illustration of the first structural embodiment of my invention shown in two different locations on a bed 14. The two different locations of use are, as stated above, to illustrate typical use positions for example, although typically only one of my bedclothes anchoring apparatuses would be used at one time on a bed. The two positions of use shown in FIG. 1 are with identical structures, and the bedclothes anchoring device shown on the right side of the bed could be moved to the left side of the bed 18. It would be a very rare situation (probably never) wherein my bedclothes anchoring device would be applied to both the center and one side edge of the bed simultaneously as shown in FIG. 1, as this is for illustrative purpose only, and clearly this would render it very difficult to enter the right side of the bed under the covers. The second embodiment of the invention using the spring clamp 12 may be placed in any location which the first embodiment is applicable, and in FIG. 5, clamp 12, extending tab 16 and the distal end of the strap 20 are shown on the right side of a bed.

Figure 2:
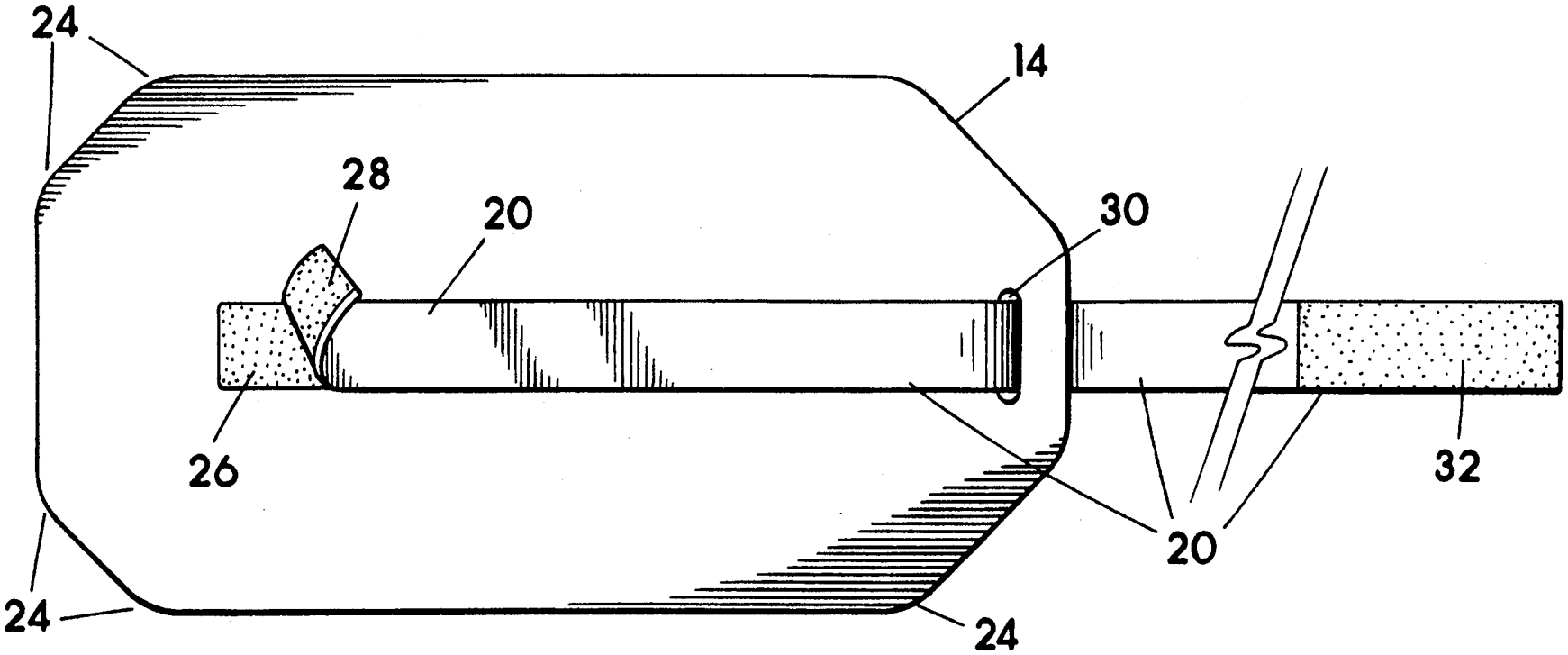
FIG. 2 is a top view of the plate-like anchor with adjustably connected strap.

FIG. 2 is a top view of my rigid plate-like anchor 14 with adjustably connected strap 20. It can be seen that the anchor 14 is elongated for the purpose of extending it a sufficient distance under a mattress 22 with the length thereof positioned perpendicular to the adjacent edge of the mattress 22 by which the anchor 14 would pass during insertion. The corners 24 of the anchor 14 are blunt or rounded to be non-damaging to the bed or bedding, and to render the anchor 14 easy to push and slide underneath a mattress. Anchor 14 may be made out of materials such as wood, plastics, metal or any other suitably rigid and inexpensive material which is not so brittle as to be subject to breaking under use.

Figure 3:
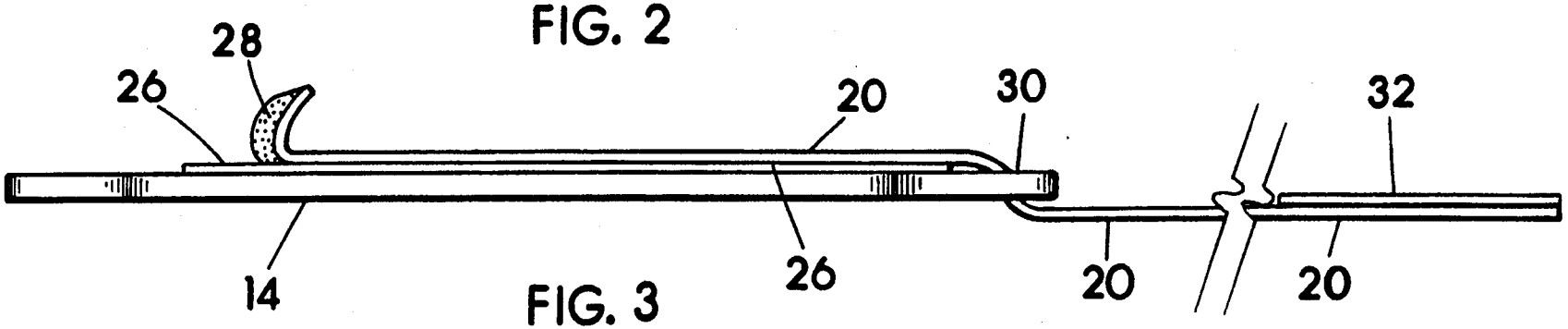
FIG. 3 is a side view of my plate-like anchor with adjustably connected strap.

FIG. 3 is a side view of my plate-like anchor 14 with adjustably connected strap 20. The strap 20 is attached to anchor 14 adjustably with a first portion of hook and loop fastener 26 glued or otherwise securely attached to the central top wide of anchor 14, extending lengthwise relative to the extended length of anchor 14. A first end of strap 20 has a securely affixed second or mating portion of hook and loop fastener 28, affixed by glue or any other suitable arrangements for attaching to the fastener 28 on the strap 20. The hook and loop fastener strips on anchor 14 and strap 20 are each elongated so as to allow a wide range of adjustment choice (overlap), as mentioned above, in order to adjust the length the strap 20 which extends from the anchor 14 for different thicknesses of mattresses. Preferably, in order to maintain the strain of pull mostly off of the hook and loop connecting the strap 20 to the anchor 14, an aperture 30 through anchor 14 serves to bind or pinch the strap 20, and thus serves as a strain insulator. Aperture 30 is relatively small, and as may be seen in FIGS. 2 and 3, the strap 20 leaves the hook and loop fastener 26 of the anchor and then sharply turns and passes through aperture 30. Strap 20 may be easily manually moved through aperture 30 to intentionally adjust the effective extending length of strap 20, and the strain relief is mainly provided by the sharp bends held in strap 20 by aperture 30 and the weight of a mattress 22 resting on top of anchor 14 and the first end of strap 20. Strap 20 is of flexible material such as fabric. Strap 20 may be made of other suitably strong and flexible materials, and leather is a material which is both flexible and strong, but often further includes a small degree of stiffness. A slight degree of stiffness in strap 20 is helpful when connecting the strap 20 to extending tab 16, as the stiffness renders the strap 20 less likely to fall completely downward off of the top of the bed should the installer momentarily release it during the connecting. The hook and loop fastener used to removably attach the anchor 14 to the strap 20 allows for very small incremental adjustments in the extending length of strap 20, and is inexpensive, readily available, available with peel off glued backings, and holds well, and these are some of the reasons it is preferred, as it is also preferred for connecting the distal end of the strap 20 to the extending tab 16 as hereinabove described. So the reader may have a general idea of size, anchor 14 is about 5 inches wide, $\frac{1}{4}$ inches thick, and about 10 inches long. Strap 20 is about 24 inches in overall length. These dimension are given only for example, and can be varied substantially and greatly within the scope of my invention.

In drawing FIGS. 2 and 3, a center section of strap 20 has been removed for the purposes of showing anchor 14 and strap 20 together in a reasonable scale. Also shown in FIGS. 2 and 3 is the second or distal end of strap 20. The distal end has an elongated first portion of hook and loop 32 securely attached on one side thereof with glue, stitching or any other suitable arrangement. The hook and loop 32 is elongated to allow varying the overlap, and in small increments, when it is removably attached to the elongated second or mating portion of hook and loop 34 securely attached to or fully defining extending tab 16.

Figure 4:
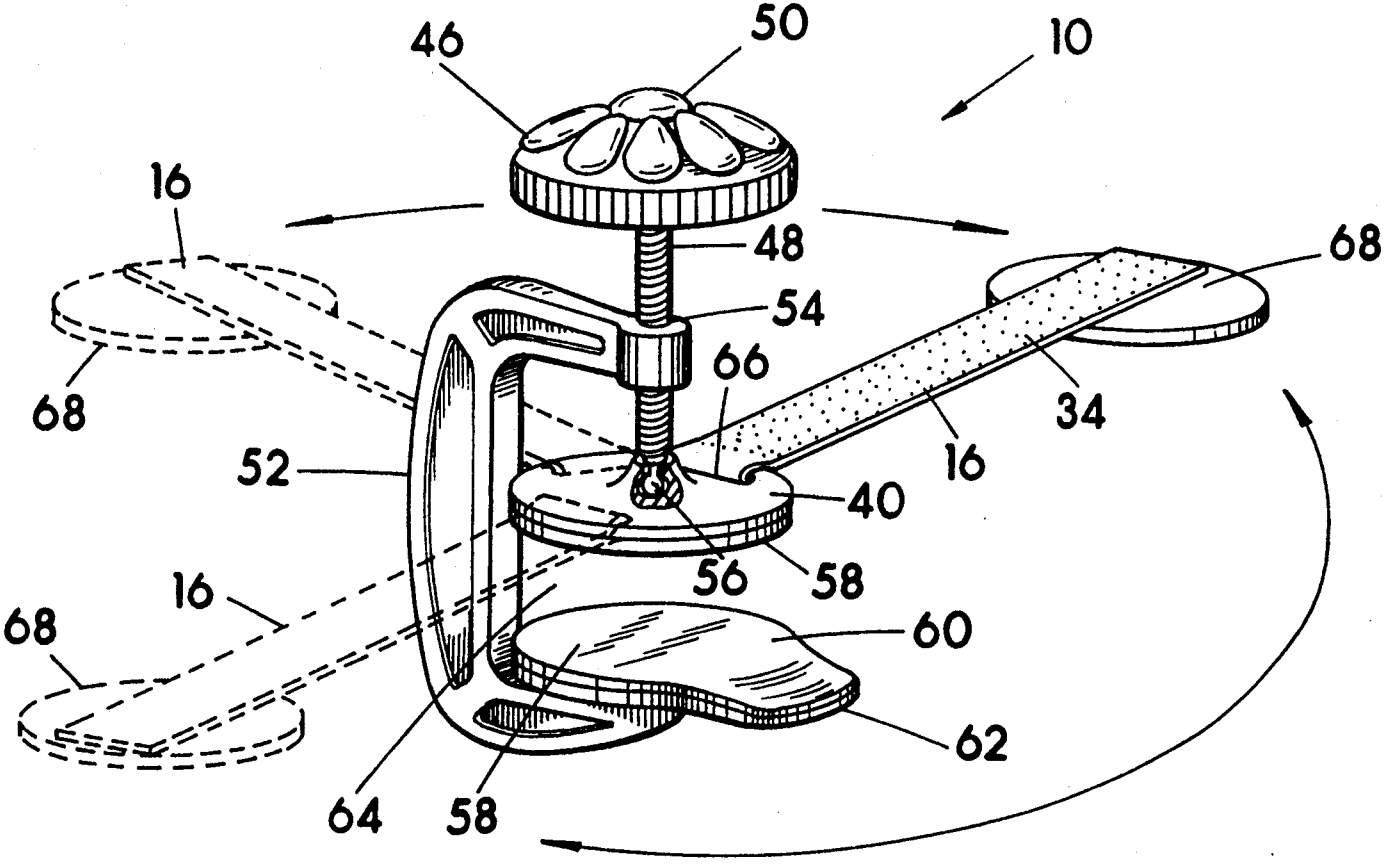
FIG. 4 shows the clamp structure of the first preferred embodiment of my invention. The extending tab is shown in solid and dotted lines illustrating the possible positions thereof.
Figure 5:
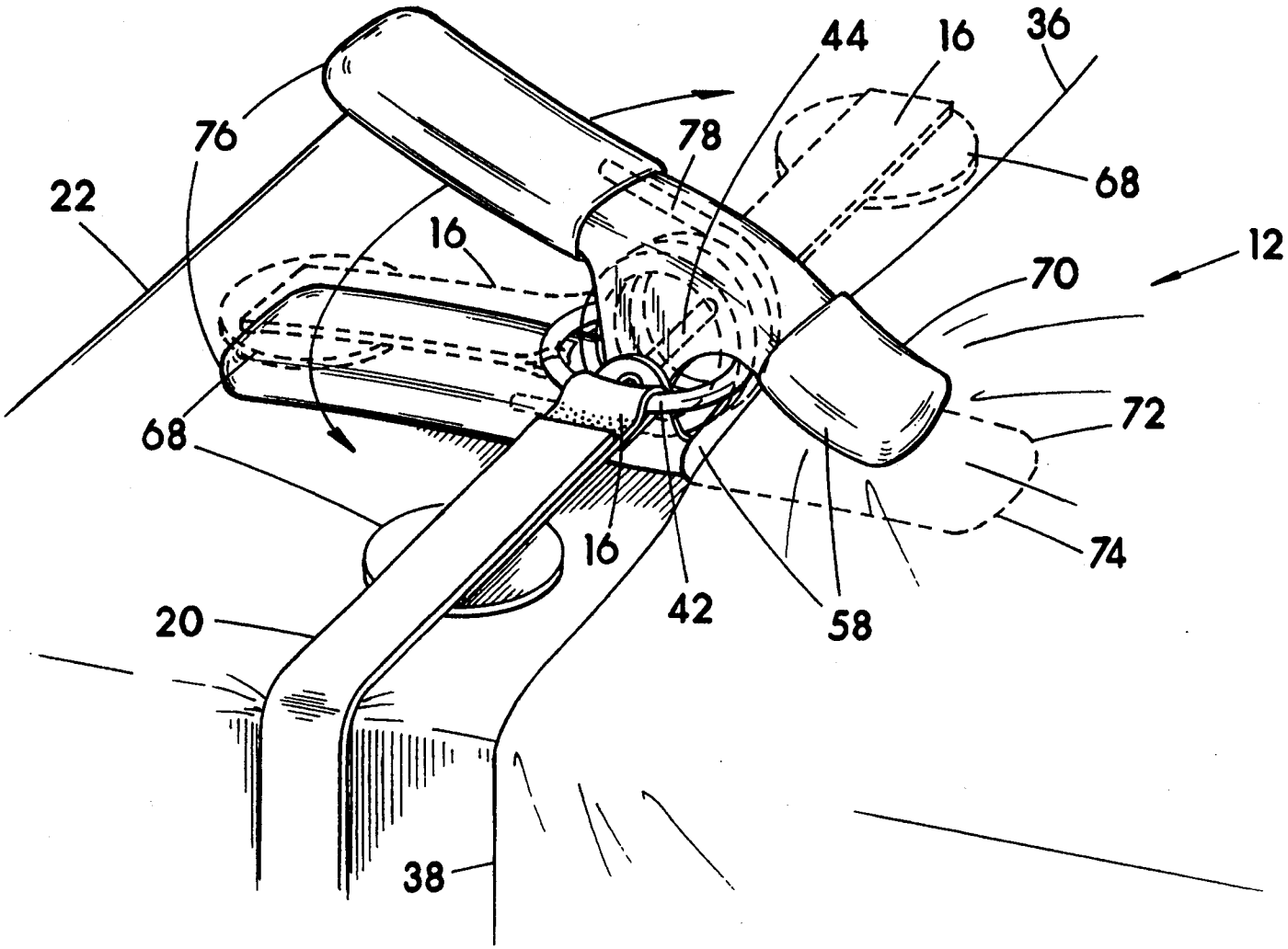
FIG. 5 shows a clamp structure of the second preferred embodiment of my invention. The view is enlarged, and the clamp is shown holding the upper edge portion of the bedclothes in place on a bed. The extending tab is shown in solid and dotted lines illustrating the possible positions thereof.

Extending tab 16 is a relatively short preferably flexible member which, as previously stated, may be entirely made from a portion of hook and loop, as these fasteners (hook and loop) are backed with flexible fabric or plastics substrates supporting the hook or loop. FIG. 4 shows clamp 10 with extending tab 16 shown in solid and dotted lines illustrating the possible positions thereof. FIG. 5 shows clamp 12; the view is enlarged, and clamp 12 is shown holding the upper edge portion 36 of the bedclothes 38 in place on a bed 18, and extending tab 16 is shown in solid and dotted lines illustrating the possible positions thereof. The pivotal connecting of extending tab 16 is accomplished differently for each of the two clamps 10 and 12. With the modified "C" clamp 10, the pivotal or rotational connection of extending tab 16 is made via connecting the tab 16 to the rotatable or pivotable upper jaw 40. Clamp 10 and the pivotal connection of extending tab 16 will be explained in detail shortly. Extending tab 16 is pivotally or rotatably connected to clamp 12 by way of affixing an end of extending tab 16 nearest the clamp 12 to a ring 42 rotatably yet captively retained around or encircling the pivotal connection 44 (fulcrum) of clamp 12, as will be further detailed after the detailing of clamp 10.

Clamp 10 is shown in FIGS. 1 and 4. Clamp 10 shown best in FIG. 4 is essentially a modified "C" clamp and includes a handle 46 rigidly affixed to a first or top end of a threaded screw 48 so that manual rotation of the handle 46 equates to rotation of threaded screw 48. Handle 46 should be relatively large outward beyond the rotational axis of threaded screw 48 so that the user gains leverage and is able to develope high clamping pressure when the jaws of clamp 10 are brought together on bedclothes. The top of the handle 46 may be decoratively finished as desired as shown at 50. Clamp 10 includes a "C" shaped rigid frame 52 as shown in FIG. 4 wherein the frame 52 includes a threaded bore 54 in which threaded screw 48 rotatably resides and is supported. The lower or second end of threaded screw 48 includes a rotatably affixed top jaw 40 of the clamp. The rotatable affixment of the top jaw 40 to the screw 48 may be accomplished via numerous known arrangements, and as shown in the drawings may be made via threaded screw 48 having a reduced diameter end portion inserted through a center bore having an enlarged opening or cavity in top jaw 40, and the terminal end 56 of threaded screw 48 then flared or expanded so it may not back out of the bore, and thus top jaw 40 is captively and rotatably retained. Top jaw 40 in shaped is essentially a flat disk of rigid material such as metal, having an affixed cover of padding or rubbery material 58 on the lower surface thereof which will abut the bedclothes. Lower or bottom jaw 60 is affixed or integrally formed at the other end of the "C" portion of clamp 10 and is stationary thereon. Top jaw 40 is moveable relative to bottom jaw 60 via rotation of handle 46 and the rising and lowering of screw 48 within threaded bore 54. Bottom jaw 60 is a plate-like member or disk additionally including a forward extending portion or flange 62 which extends outward beyond top jaw 40 to serve as a guiding or starter lip when slipping the edge bedclothes between the open jaws in preparation for clamping. The upper surface of flange 62 and bottom jaw 60 are also cover with padding or rubbery material 58 like that of top jaw 40, and for the same reasons. The padding or rubbery material 58 should be of a nature which provides some frictional adhesion with bedclothes, and rubbery material which provides some degree of padding or resiliency will work best, and may be affixed in place on the jaws with glue or any other suitable arrangement. The "C" shape of frame 52 supports jaws 40 and 60 outward or slightly away from the adjacent portion of the frame to define a throat 64.

Extending tab 16 is affixed to top jaw 40 via a slot 66 through an outward edge of the jaw, and an end portion of the extending tab 16 pushed through the slot 66 and brought back onto itself and affixed with glue or stitching or the like. Since top jaw 40 is rotatable on the end of screw 48, it can be appreciated that extending tab 16 may be swung into numerous positions as hereinabove described and as shown in the drawings. Extending tab 16 may be positioned toward the left, right or extending toward the rear of clamp 10 as shown in the drawings.

Extending tab 16 on both clamps 10 and 12, as hereinabove described, includes an affixed lateral extending portion which serves as a graspable tab 68 or handle which the user may grasp between his fingers while connecting elongated strap 20 to the extending tab 16. Graspable tab 68 of extending tab 16 is off to the side, and preferably both sides of the hook and loop fastener on the extending tab 16 which mates with the hook and loop fastener on the distal end of strap 20, and thus the user may easily hold the extending tab 16 while pulling strap 20 to remove all slack within extending tab 16 and strap 20 between the clamp 10 or 12 and anchor 14 to better secure the bedclothes in place and to prevent the bedclothes from becoming untucked adjacent the extension of strap 20 from underneath the mattress. As hereinabove described, the adjustability in overlap in the elongated hook and loop fasteners on the distal ends of strap 20 and extending tab 16 allows for affixing the clamp 10 or 12 to the bedclothes, followed by connecting extending tab 16 to strap 20 without leaving any slack.

Referring now to drawing FIG. 5 for a more detailed description of spring clamp 12. Clamp 12 is essentially a slightly modified spring clamp of the type widely sold and used in the wood craft industry. The modifications to clamp 12 includes the extending forward of the lower jaw 72 so that it extends outward beyond the upper jaw 70 to define an extension 74 as shown in the drawing and as previously described for use as a guide or starting flange. As described above, the jaws of clamp 12 are preferably covered with padding or rubbery material 58. Clamp 12 includes two opposing handles 76 which when manually squeezed together cause pivoting at a pivot and connection 44 which serves as a fulcrum to open the jaws 70 and 72. Located at the pivot and connection 44, essentially within the clamp 12, is a torsion spring 78 which is arranged to bias the jaws 70 and 72 tightly closed when squeezing pressure is released from handles 76. As mentioned above and shown in the drawings, with clamp 12, extending tab 16 is pivotally or rotatably connected to clamp 12 by way of affixing an end of extending tab 16 nearest the clamp 12 to ring 42, with ring 42 being rotatably yet captively retained around or encircling the pivot and connection 44 of clamp 12 so that extending tab 16 may be positioned toward the left, right or extending toward the rear of clamp 12 as shown in the drawings.

Figure 6:
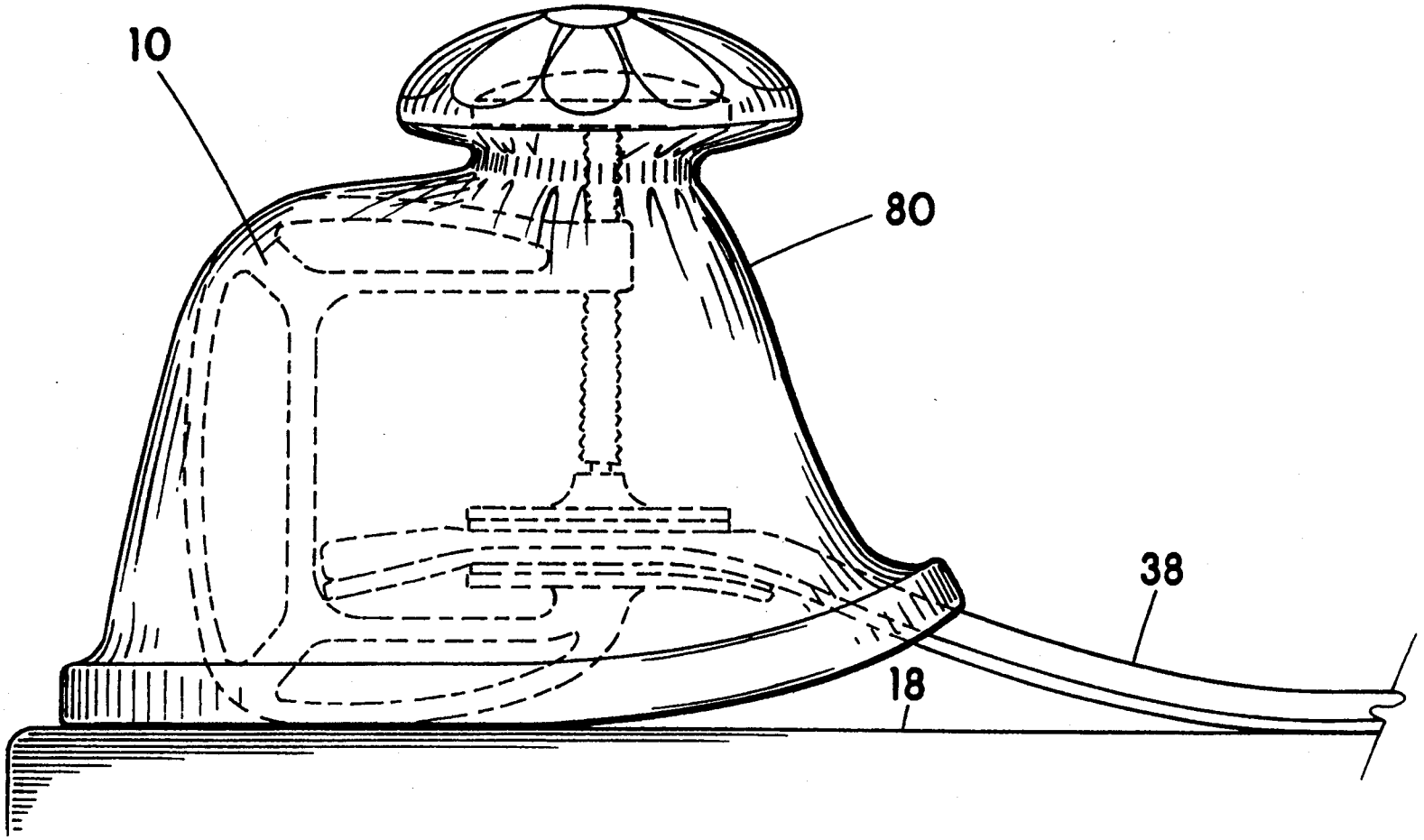
FIG. 6 is an illustration of an optional cover, which preferably includes some padding, which may be slipped over either of the clamps used in the present invention to pad the clamp, or to decoratively conceal the clamp, or both.

FIG. 6 is an illustration of an optional cover 80, which preferably includes some padding, which may be placed over either of the clamps used in the present invention to pad the clamps, or to decoratively conceal the clamp, or both.

Although I have very specifically described the preferred structures and use of the invention, it should be understood that some changes in the specific structures described and shown in my drawings may clearly be made without departing from the true scope of the invention in accordance with the appended claims. For the sake of briefness of this disclosure, I have not detailed all of what I feel would be generally feasible variations to many of the structures which those skilled in the art will determine to be substantially equivalent to my preferred structures and embodiments.

What I claim as my invention is:

1. A bedclothes anchoring apparatus for rendering an upper edgeward portion of bedclothes upon a bed generally stationary while the bed is slept in, and for aiding in making of the bed after the bed has been slept in, said bedclothes anchoring apparatus comprising, a substantially rigid plate-like anchor for placement underneath a mattress of a bed, said anchor sized and shaped to provide sufficient surface area contact and frictional engagement with the mattress as to remain generally stationary during use;

an elongated flexible strap extendingly attached at a first end thereof to said anchor by adjustable attachment means for allowing adjustment in the extending length of said strap from said anchor for accommodating mattresses of different thicknesses, said adjustable attachment means including a first portion of hook and loop fastener attached to said anchor, and a mating portion of hook and loop fastener affixed to said first end of said strap and connected to said first portion of hook and loop fastener on said anchor, said adjustable attachment means further including said strap passing through a relatively small and binding aperture through said anchor;

a second end of said strap having a first portion of hook and loop fastener attached thereto;

a clamp having a top jaw and a bottom jaw opposing said top jaw, said clamp including adjustment means allowing for adjustments in spacing between said top and bottom jaws for allowing placement of bedclothes between the jaws and the clamping and thus securing of the bedclothes to said clamp;

said top and bottom jaws each including anti-slip padding means for reducing slippage of bedclothes from between said jaws, and for rendering said jaws generally non-damaging to bedclothes;

said bottom jaw extending outward beyond that of said top jaw with the extension of said bottom jaw being in at least a forward portion of said bottom jaw so as to serve as a starting edge in readily slipping bedclothes between said top and bottom jaws;

an extending tab pivotally attached at a first end thereof to said clamp, said extending tab having a second end having a portion of hook and loop fastener suitable for attaching to said hook and loop fastener on said second end of said strap, said second end of said extending tab including a graspable tab positioned for grasping and the stabilizing of said extending tab while connecting the hook and loop fastener portion of said extending tab to the hook and loop fastener portion of said second end of said strap, the pivotal attachment of said first end of said extending tab providing means for rotatably pivoting said extending tab so as to allow selective positioning of said extending tab in left, right and rearward extensions relative to said clamp so as to allow positioning of said bedclothes anchoring apparatus in multiple positions, one position at a time on the bed.

2. A bedclothes anchoring apparatus according to claim 1 wherein said clamp further includes a frame supporting said bottom jaw, said frame further supporting a rotatably affixed threaded screw having a handle at a first end of said threaded screw and said top jaw rotatably affixed at a second end of said threaded screw, said frame with said threaded screw and said handle providing means for leveraged high pressure clamping of the bedclothes between said jaws; said extending tab attached to said top jaw of said clamp; the rotatable aspect of said top jaw providing the pivotable aspect of said extending tab.

3. A bedclothes anchoring apparatus for rendering an upper edgeward portion of bedclothes upon a bed generally stationary while the bed is slept in, and for aiding in making of the bed after the bed has been slept in, said bedclothes anchoring apparatus comprising, a generally rigid plate-like anchor for placement underneath a mattress of a bed, said anchor sized and shaped to provide sufficient surface area contact and frictional engagement with the mattress as to remain generally stationary during use;

an elongated flexible strap extendingly attached at a first end thereof to said anchor by adjustable attachment means for allowing adjustment in the extending length of said strap from said anchor for accommodating mattresses of different thicknesses, a second end of said strap having a first portion of a two-piece fastener attached thereto;

a clamp having a top jaw and a bottom jaw opposing said top jaw, said clamp including adjustment means allowing for adjustments in spacing between said top and bottom jaws for allowing placement of bedclothes between the jaws and the clamping and thus securing of the bedclothes to said clamp;

an extending tab pivotally attached at a first end thereof to said clamp, said extending tab having a second end having a second portion of a two-piece fastener suitable for attaching to said first portion of two-piece fastener on said second end of said strap, the pivotal attachment of said first end of said extending tab providing means for rotatably pivoting said extending tab so as to allow selective positioning of said extending tab in left, right and rearward extensions relative to said clamp so as to allow positioning of said bedclothes anchoring apparatus in multiple positions, one position at a time on the bed.

4. A bedclothes anchoring apparatus according to claim 3 wherein said clamp further includes a frame supporting said bottom jaw, said frame further supporting a rotatably affixed threaded screw having a handle at a first end of said threaded screw and said top jaw rotatably affixed at a second end of said threaded screw, said frame with said threaded screw and said handle providing means for leveraged high pressure clamping of the bedclothes between said jaws; said extending tab attached to said top jaw of said clamp; the rotatable aspect of said top jaw providing the pivotable aspect of said extending tab.

* * * * *